US006230342B1

(12) United States Patent
Haugs

(10) Patent No.: US 6,230,342 B1
(45) Date of Patent: May 15, 2001

(54) METHOD AND APPARATUS FOR HANDLING OF A PERSON IN A ROCKING MOVEMENT IN RELATION TO A BED

(76) Inventor: Audun Haugs, Nattlandsfjellet 56, N-5030 Landas (NO)

( * ) Notice: Subject to any disclaimer, the term of this patent is extended or adjusted under 35 U.S.C. 154(b) by 0 days.

(21) Appl. No.: 09/125,617

(22) PCT Filed: Feb. 25, 1997

(86) PCT No.: PCT/NO97/00059

§ 371 Date: Aug. 21, 1998

§ 102(e) Date: Aug. 21, 1998

(87) PCT Pub. No.: WO97/30674

PCT Pub. Date: Aug. 28, 1997

(30) Foreign Application Priority Data

Feb. 26, 1996 (NO) ..... 960760

(51) Int. Cl.[7] ..... A61G 7/057
(52) U.S. Cl. ..... 5/607; 5/609; 5/615; 5/715
(58) Field of Search ..... 5/607, 609, 615, 5/710, 713, 715, 732, 742

(56) References Cited

U.S. PATENT DOCUMENTS 3,485,240 * 12/1969 Fountain ..... 5/609 X
3,862,454 * 1/1975 Mazzucconi ..... 5/607 X
3,875,598 * 4/1975 Foster et al. ..... 5/607
5,142,719 * 9/1992 Vrzalik ..... 5/609
5,774,917 * 6/1998 Liu ..... 5/715
5,833,291 * 11/1998 Haugs ..... 5/615 X

FOREIGN PATENT DOCUMENTS 0599123 6/1994 (EP) .
351130 11/1972 (SE) .
9510997 4/1995 (WO) .

* cited by examiner

*Primary Examiner*—Michael F. Trettel
(74) *Attorney, Agent, or Firm*—Fulbright & Jaworski, LLP

(57) ABSTRACT

A process and an arrangement handles a person in a rocking movement on a couch relative a base by means of pressure medium driven actuating means in the couch. The couch is converted from a substantially planar or slightly bent starting position, with the person resting against the couch to a C-shaped holding position, bent about the longitudinal axis of the person. The person is rocked relative to the base in a rocking movement from side to side on the base maintained in aid C-shaped holding position.

11 Claims, 6 Drawing Sheets

FIG. 1
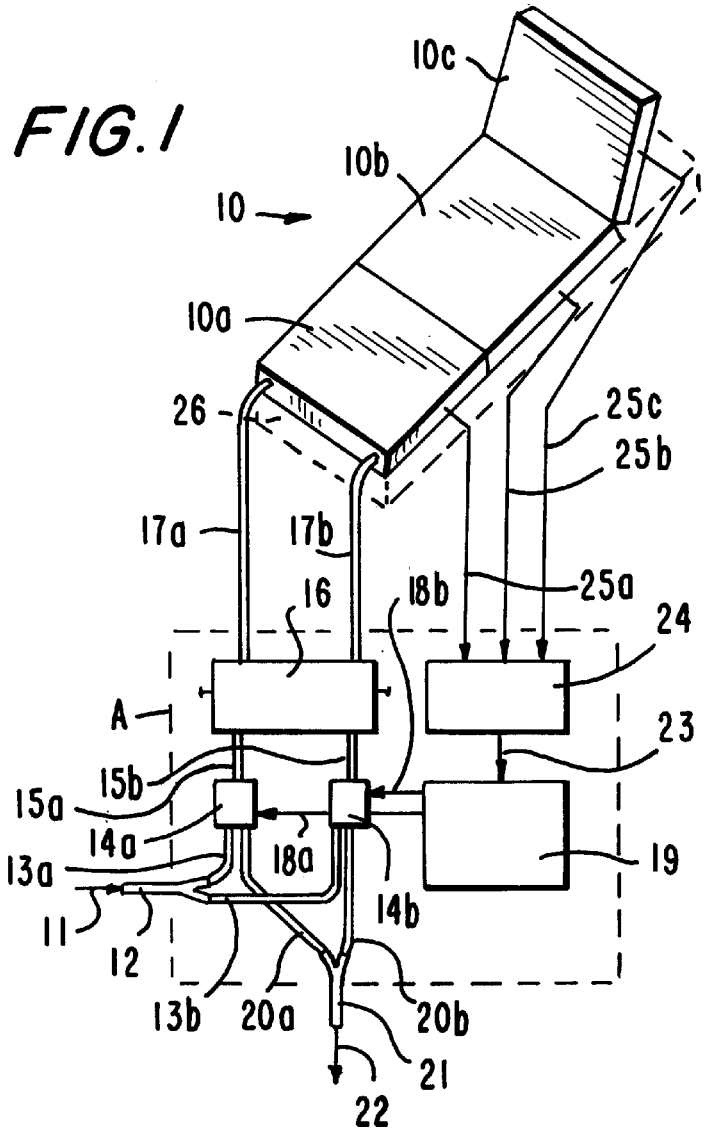
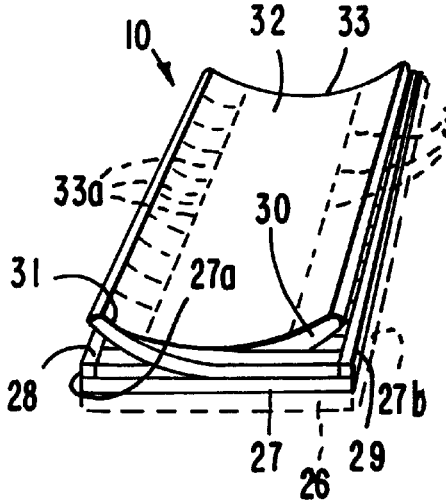
FIG. 2
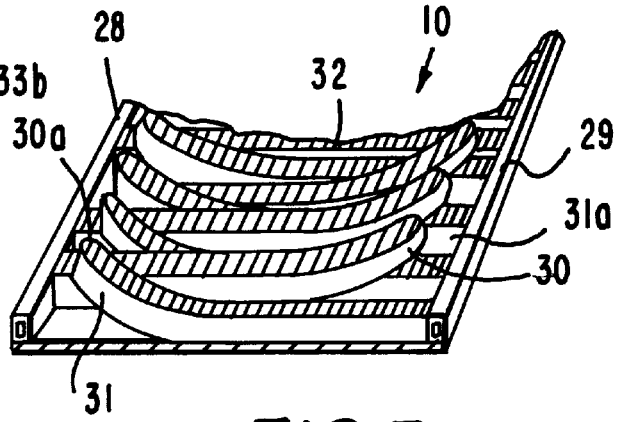
FIG. 3

FIG. 4
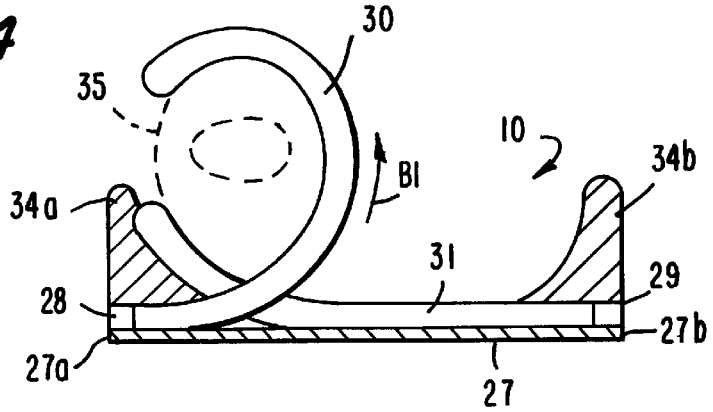
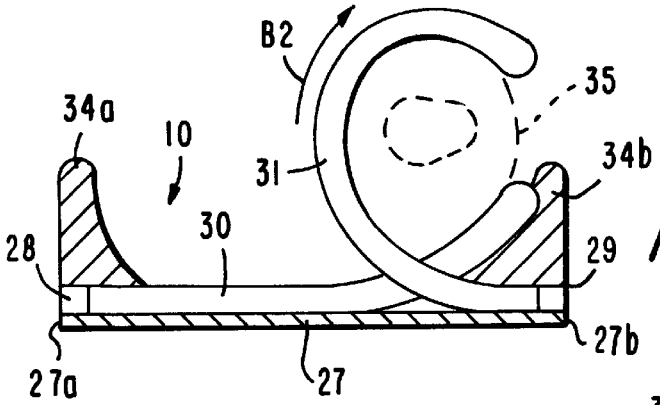
FIG. 5
FIG. 6
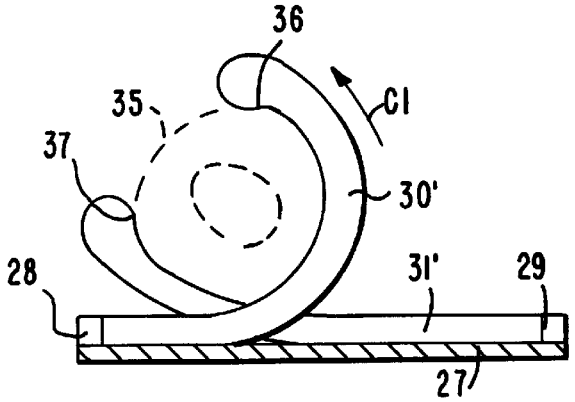
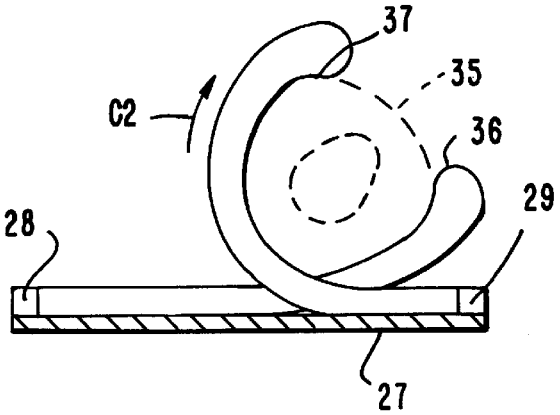
FIG. 7

METHOD AND APPARATUS FOR HANDLING OF A PERSON IN A ROCKING MOVEMENT IN RELATION TO A BED

The present invention relates to a method and apparatus for moving a person in a rocking movement on a couch in relation to a base by pressure medium driven actuating means.

The present invention accordingly relates to a method for moving a person in a rocking movement on a couch relative to a base by means of pressure medium driven actuating means incorporated in the couch, including supporting the person on the couch and converting the couch by means of the pressure medium driven actuating means from a substantially planar or slightly bent starting position to a C-shaped holding position, including allowing the person to be enveloped in a holding grip over an arc angle of about 180° in the C-shaped holding position of the couch, followed by rocking the person about its longitudinal axis from side to side over the base.

The present invention further relates to an apparatus for moving a person in a rocking movement on a couch relative to a base, including said couch and said base and a pressure medium driven actuating means, said means being incorporated in the couch, said couch being convertible from a substantially planar or slightly bent starting position to a C-shaped holding position, by means of said actuating means, which means allows the couch to envelope the person in a holding grip over an arc angle of about 180° in the C-shaped holding position of the couch and allows the person to be rocked about his longitudinal axis from side to side relative to the base.

The method and apparatus according to the invention are designed in particular for moving a person/patient in a rocking movement on a base. The term "rocking" movement is understood to mean both a continuous sideways movement between two maximum outer positions and a stepwise movement between two or more successive positions.

The actuating means are adapted first for gripping around a person in order to hold him in a controlled holding grip, and thereafter subjecting the person to a suitable sideways rocking movement with the person maintained in said controlled holding grip.

The rocking movement may be employed for various purposes in connection with the physical activation of the person/patient lying in a position of rest. For example, the arrangement may be used for patients with diminished physical or diminished mental activity. In addition, the arrangement may be used on patients, who in a lying position, are prone to the occurrence of bed sores or other irritations in connection with their limited ability to move. When a patient is moved in a nursing situation, it is especially important to turn the patient an arbitrary angle of rotation about his longitudinal axis. An angle of rotation of interest may be 0–90° or more. The movement may take place in a relatively slow, rhythmic movement or in a more staggered or time-intermittent rocking movement. An aim is to be able to move the person in a controlled, reliable manner, but at the same time in a particularly adapted, comfortable and not intimidating manner.

A method and apparatus of the aforementioned type is shown and described in WO 95/10997. A blanket-like arrangement designed with a number of chambers mutually joined together and running parallel in the longitudinal direction of the blanket is illustrated therein. The chambers are arranged in two facing chamber groups, e.g. with one chamber group on each side of a common middle section.

The chamber groups can be bent and straightened in groups or separately between planar and slightly bent contours and an almost J-shaped contour. Alternatively, the chamber groups may be bent collectively toward and away from each other, i.e., from substantially planar or slightly curved contour to a very curved, almost U-shaped contour.

In this embodiment the user is subjected to a rocking movement by activating one half of the apparatus at a time. More specifically, the patient may be swung from lying on his back to lying on his side by activating one half of the bed couch, and returned to his back by bringing the half of the couch back to its starting position. Equivalent rocking onto the other side may be carried out using the other half of the couch arrangement, thus giving the sideways rocking movement.

Alternatively, the bed couch may be brought into a U-shaped contour around the bedridden to hold him securely on his back. In this case, the controlled rocking movement of the bedridden will not take place.

In an alternative embodiment of this reference the bedridden may be subjected to a rocking movement in a U-shaped bed couch via an extra pivot axis arranged at a level above the bottom of the bed. In practice, the level of the pivot axis above the bottom of the bed will limit the possibility for pivoting the bed couch relative to the bed bottom. The level at which the pivot axis is placed is consequently determinative of the rocking possibilities for the U-shaped bed couch.

Normally, the rocking movement can only occur at a moderate pivot, or tilting, angle of up to 20° between the maximum positions. Even with the pivot axis arranged at a considerable height above the bottom of the bed, only a rather limited tilting angle is possible for the bed couch. The rocking movement is effected by means of extra air cushions, which are all arranged on opposite sides of the pivot axis between the bottom of the bed and the bed couch, by alternately filling and emptying the air cushions one after the other.

There may in many cases be a need for larger pivot angle for reasons of treatment or movement, with a controlled holding grip around the person, especially for the maximum tilted positions. There is generally a need to hold a person at a low level above the base to be able to move the person easily and securely in contexts other than during the tilting movement itself.

In certain contexts the such a pivot axis represents design complications in connection with the base, such that it may be difficult to perform the rocking movement in a rational way on different bases and especially in sickbeds with sectionally swingable bed couches, for example on sickbeds with socalled "heart boards".

An object of the present invention is to provide an apparatus which is easy to use with nearly any base, and which allows for arbitrarily large rocking movements. For example, it is an object of the present invention to perform one single swing movement between the maximum positions at swing arches of 90–180° if necessary.

The method of the present invention is characterized in that pressure medium driven actuating mean changes the couch from a substantially planar or slightly curved starting position, with the person/patient resting on the couch, to a holding position curved around the person/patient's longitudinal axis, with the person kept in a holding grip through a swing arc of up to 180°, whereupon the person in the holding grip of the couch is rocked in relation to the base in a sideways rocking movement.

Correspondingly, the apparatus according to the invention in that the couch can be converted from a predominantly planar or slightly curved starting position, with the person lying on the couch, to a position in which there exists a holding grip around the person's longitudinal axis, by a pressure medium driven actuating means, with the person enveloped in an engagement grip having an arc of 180°, and in that the couch in this holding position may be moved by pressure-medium driven actuating means in a sideways rocking movement in relation to the base.

According to the invention the patient/person may be subjected to a sideways rocking movement in relation to the base with a relatively low center of gravity for the person relative to the base and without the use of a space demanding pivot axis. By replacing the known pivot or tilting movement with a rocking movement an especially beneficial solution is achieved, which can easily be adapted to existing bases without significant construction complications. In other words, the solution may be applied on conventional bases in conventional beds as well as on specially designed bases, for example on hospital beds.

The apparatus according to a first aspect of the present invention is characterised in that the couch, which is made into the aforementioned C-shaped holding grip by a first set of pressure-medium driven actuating means, may be rocked directly on an associated base, controlled by a second set of actuating means without the use of pivot axis.

Thus, by omitting the pivot mechanism between the bed couch and the bed base according to a controlled rocking movement of said C-shaped bed couch by said second set of actuating mean can be achieved without the use of a pivot axis. This is achieved by placing the bed couch so that it moves with support directly against the base, i.e. at the lowest possible level on the bed couch. By using said set of actuating means, an effective control of the rocking movement of the bed couch between the two maximum positions can be ensured.

The apparatus according to the invention may in general be used in connection with various types of gripping mean according to the invention. There is herein, however, discussion about pressure medium driven gripping means and especially compressed airdriven gripping means, for example the gripping means shown in WO 95/10997. Hydraulically or pneumatically driven gripping means are preferred in techniques illustrated and disclosed in European patents Nos. 478.542, 479.778 and 555.306.

A particularly preferred solution of the apparatus is characterised in that the actuating means are common means for converting the couch, between a substantially planar or slightly bent position to a heavier bent, C-shaped cradle-formed holding position and for controlling the couch in a rolling movement backwards and forwards on or relative to the base.

The above mentioned arrangement may be used to convert the bed couch to a C shape by one and the same set of actuating means and thereafter move the bed couch relative to the base to provide the said side to side rocking movement to the patient.

Further features of the apparatus according to the invention will be evident from the following description with reference to the accompanying drawings, wherein:

FIG. 1 shows schematically an apparatus according to the invention including an associated regulating device.

FIG. 2 shows schematically in perspective certain details of the apparatus according to a first embodiment of the invention.

FIG. 3 shows in perspective a segment of FIG. 2 and the mutual placement of the gripping means of the apparatus, shown in an inactivated ready-for-use state.

FIGS. 4–5 show schematically a cross-section of a rocking movement for a patient who is enveloped by gripping means as shown in FIGS. 1–3, with the gripping means illustrated in a fully activated state.

FIGS. 6–7 show a cross-section corresponding to FIGS. 4–5 of a somewhat modified embodiment of the gripping means according to FIGS. 4–5.

An arrangement 10 for moving a person in a rocking movement on a base is shown schematically in FIG. 1. The apparatus 10, herein also termed "patient turner", is adapted to grip the person around the major part of the circumference of the body (patient's back and sides) at different local regions in the longitudinal dimension of the person, to keep the person in a secure and effective holding grip. Thereafter, the arrangement will allow the person to be subjected to a suitable sideways rocking movement about his longitudinal axis relative to the base. The rocking movement may occur over an arbitrary angle of rotation of, for example, 0–180°, to and from the two maximum positions.

Figure 10:
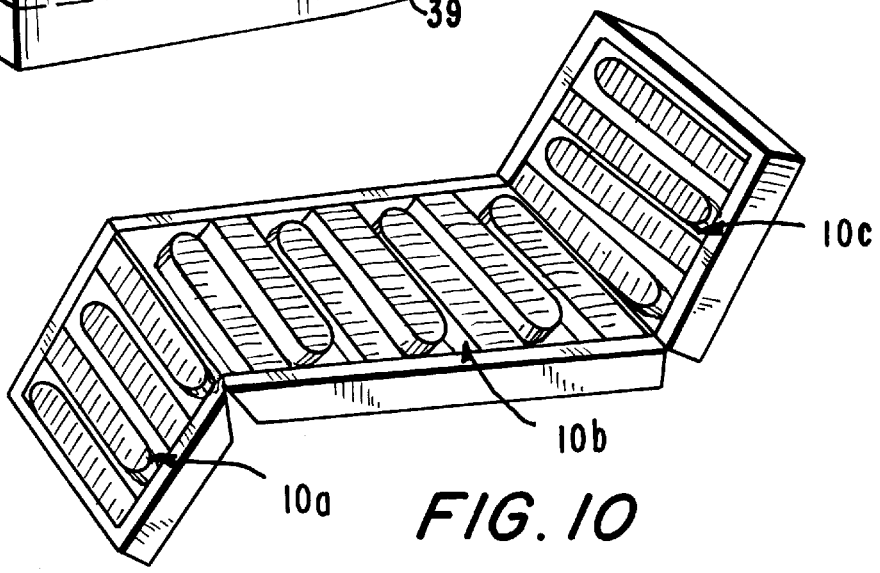
FIG. 10 shows in perspective an apparatus according to the invention in an actual use position illustrated in an inactivated state.

In addition to the aforementioned rocking movement, it may be necessary to adjust the person into various sitting or resting positions, e.g., a position suitable for eating, as indicated in the position shown in FIG. 10.

In FIG. 1 the broken line illustrates schematically a control cabinet for controlling the movements of components of the patient turner 10. The movable components of the patient turner 10 are operated by means of compressed air from a compressed air source, as shown by an arrow 1 via a primary supply conduit 12 and secondary branch conduits 13*a*, 13*b*, which are each fitted with associated three-way control valves 14*a*, 14*b*. Alternatively, pressure fluid may be used as a pressure medium. In a first position, the control valves 14*a*, 14*b* may individually supply compressed air in their respective conduits 15*a*, 15*b*, via a speed and pressure regulating valve 16 and their respective conduit connection 17*a*, 17*b*, to a first and second pressure-medium circuit of the patient turner 10, such as will be described hereinafter.

In the illustrated embodiment according to FIG. 1, an especially simple arrangement is shown with only two control valves 14*a*, 14*b* and associated compressed air conduits 13*a*, 13*b*; 15*a*, 15*b*; 17*a*, 17*b*, for leading compressed air to and from components of the patient turns 10, thus bringing about a rocking movement of the patient relative to the base.

The valve 16 which is common to the first and second pressure medium circuits is shown in the form of a manually regulated valve, so that the speed of the movement and power of the movement of the patient turner may readily be adapted as needed for each patient, depending on body size, state of health and treatment situation, etc. Alternatively, the valve 16 may be controlled by a microprocessor or other control means having an associated control program in a manner not shown further.

The three-way valves are controlled separately using a common microprocessor 19, as shown schematically by the arrow lines 18*a* and 18. The microprocessor 19 is programmed for alternate opening and closing of the valves 14*a* and 14*b* in different sequences individually, i.e. for the supply of compressed air from the source of compressed air 11 to the patient turner 10 and for emptying discharge air from the patient turner 10 from the respective valves 14*a*, 14*b*, via branch discharge conduits 20*a* and 20*b* respectively to a principal discharge conduit 21 for a suitable air discharge as indicated by the arrow 22.

The microprocessor is controlled, as indicated by an arrow 23, with the aid of a pressure sensor 24. The pressure sensor 24 is fed with pressure signals via conduits 25*a*, 25*b*, 25*c* from each of the three separate sections 10*a*, 10*b*, 10*c* of the patient turner 10 shown herein. In practice, any number of separate sections of the patient turner may be employed.

Instead of the relatively simple arrangement illustrated with a pair of conduits 17*a* and 17*b* servicing the three illustrated sections 10*a*–10*c* of the patient turner, a pair of such conduits may alternatively be employed for each section 10*a*–10*c*, so that each section may be individually controlled with a different force of engagement against the patient, as needed. If desired, separate valves 14*a*, 14*b* can be employed for each section so that they may be individually activated or deactivated as require.

In FIG. 2, the patient turner 10 is shown in a ready-for-use state with partially pressurized components. A base of a conventional bed is indicated with broken lines 26 with the patient turner 10 lying on the base 26. As shown in FIG. 2, the patient turner 10 comprises a sheet-shaped bottom member 27, which rests on the base 26. The bottom member 27 is fitted with elongated duct-shaped supporting means 28 and 29 along the respective opposing longitudinal edge strips 27*a*, 27*b*, The support means 28, 29 each carry their respective group of finger-like gripping and holding means 30, 31 which constitute said air-filled components of the patient turner 10.

A segment of FIG. 2 is shown in FIG. 3. A first group of gripping and holding means 30 is shown projecting laterally outwards from an associated first supporting means 28 in a first direction (from left to right in the drawing), while a second group of gripping and holding means 31 correspondingly projects laterally outwards from an associated second supporting means 29 in the opposite direction (from right to left in the drawing). The means 30 and 31 are separately arranged with a certain sideways distance along the associated supporting means 28, 29, so that mutual intermediate spaces, 30*a* and 31*a* respectively, are formed. The finger like gripping and holding means 30, 31 are placed alternately between each other to form a more or less continuous couch 32 on top of the patient turner 10.

A sheet 33 with an associated set of locally defined pockets 33*a* and 33*b* along opposite longitudinal edges of the sheet is shown in FIG. 2, as the outer free edges of the means 30 is received in a first set of pockets 33*a*, while the free outer edges of the means 31 are received in a second set of pockets 33*b*. In the embodiment illustrated in FIG. 2, the sheet 33 forms together with the underlying means 30, 31 said couch 32 and ensures that the means 30 and 31 respectively are guided into a specific engagement with each other. More specifically, the pockets 33*a* ensure that the means 30 are moved together in sections, while the pockets 33*b* ensure that the means 31 are correspondingly moved together in sections. Separate sheet 33 may be readily removed for sterilization or similar cleaning when required. At 30*b* in FIG. 8 , a strip of Velcro for fastening the means 30 in the inner portion of the associated pocket 33*a* is shown.

In an alternative embodiment (not shown), the sheet 33 may be replaced by two separate sheet strips, which are each fitted with pockets, corresponding to those shown for the sheet 33. For example, the pocket-carrying sheet strips may be permanently fastened independently of each other to the free outer edges of their respective group of means 30 and 31. Alternatively, the sheet strips can be readily removed and, for example, may be retained during use with straps or other suitable fastening devices on the associated group of means 30,31.

In the pocket formation arising between the pockets 33*a*, 33*b* which receive the outer edges of the group of means 30,31, for example, cushion-forming spacing devices may be arranged, and these together with the sheet 33 and the pockets 33*a*,33*b* may form a continuous edge support member for the respective group of means 30,31. A corresponding effect may also be achieved by the use of spacing devices in the pocket formations in the separate pocket-carrying sheet strips.

In FIGS. 4 and 5 an end view of the patient turner 10 is shown, where the groups of gripping means 30,31 are illustrated by a single gripping means 30 and a single gripping means 31 in two opposite maximum positions respectively. FIGS. 4 and 5 show stationary cushion forming edge stoppers 34*a* and 34*b* along opposite sides of the bottom member 27, secured partly to the bottom member 27 and partly to the support means 28,29. The edge stoppers 34*a*,34*b* prevent by dampening and buttressing, the patient 35 swinging beyond the maximum positions as shown in FIGS. 4 and 5 by the broken lines.

The maximum outer positions, as illustrated in FIGS. 4 and 5, are achieved by readjusting the valves 14*a* and 14*b* (FIG. 1) in the filling position and emptying position respectively in the first operating sequence, and in an emptying position and filling position in a second operating sequence.

In a suitable starting position, as indicated in FIG. 2, the patient 35 may, for example, have his back facing downwards towards the upper side of the patient turner 10, whereupon both groups of means 30, 31 may be moved collectively from the inactive position shown in FIG. 2 to an activated, curved position, wherein the gripping means substantially envelop the patient 35, while the patient still has his back facing downwards. Thereafter, the tilting movement may be effected and side to side between the maximum outer positions, as shown in FIGS. 4 and 5. One rocking movement of the patient 35 is indicated in FIG. 4 by the arrow B1, while in FIG. 5 the arrow B2 indicates the second rocking movement.

A modified construction of the gripping means is shown in FIGS. 6 and 7, illustrated by gripping means 30' and 31', which are fitted with a thickened head portion 36 and 37 at the respective opposite ends of the gripping means. In such a case the edge stoppers 34*a*,34*b* as shown in FIGS. 4 and 5, may be omitted if necessary. The rocking movement of the patient 35 towards the maximum outer positions in FIGS. 6 and 7 are indicated by the arrows C1 and C2.

Figure 8:
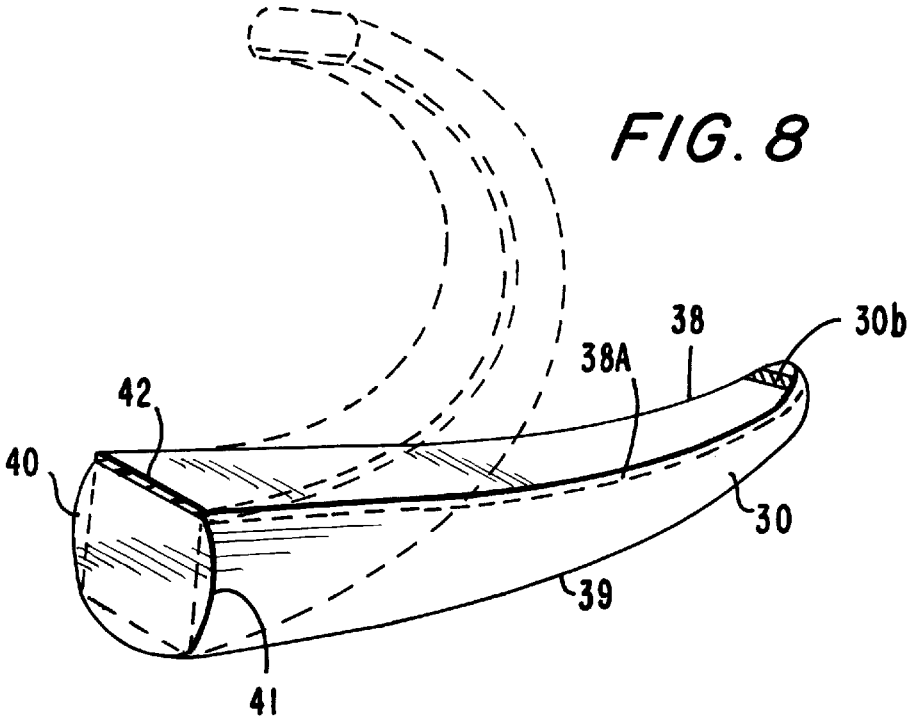
FIG. 8 shows a gripping means of a first embodiment in two maximum outer positions, illustrated with full and broken lines respectively.

A perspective view of a cross-section of a gripping means 3 is shown in FIG. 8. The gripping means is made of a gas-tight cloth. The gripping means is made in the shape of an outer cover 38A, which comprises a top part 38, a bottom part 39 and two opposite side parts 40,41.

The cover 38A is tailored in the shape shown in FIG. 8 with broken lines. More specifically, provisions are made for the longitudinal dimension of the top part 38 to be considerably less than the longitudinal dimension of the bottom part, while the side parts have a curved contour in the longitudinal direction. The top part 38 of cover 38A is attached on the inside to a straight, elongated reinforcement device 42 in the form of a relatively thin, elastically yielding blade spring. The solid lines in FIG. 8 show the blade spring 42 in an inactivated, straight state and with the cover 38A in an equivalent inactivate state, i.e., non-pressure loaded. In the condition illustrated by the broken lines, the cover 38A is shown in an activate state, i.e. compressed air loaded, with maximum dilation of the walls 40,41 and the bottom part 39 and the resulting bending of the blade spring 42 to a substantially semicircular shape against the inherent force of the spring. On emptying compressed air from the cover 38A, the cover 38A returns from its activated shape, which is shown by the broken lines, to an approximately straight shape, as shown by the solid lines, by means of the spring force of the blade spring 42. By regulating the filling of the cover 38A with compressed air, the bending of the gripping means 30 may be correspondingly regulated and thereby the rocking of the person will be regulated, since at the same time as the group of gripping means 30 is filled with compressed air, compressed air is emptied from the group of gripping means 31, and vice versa.

Figure 9:
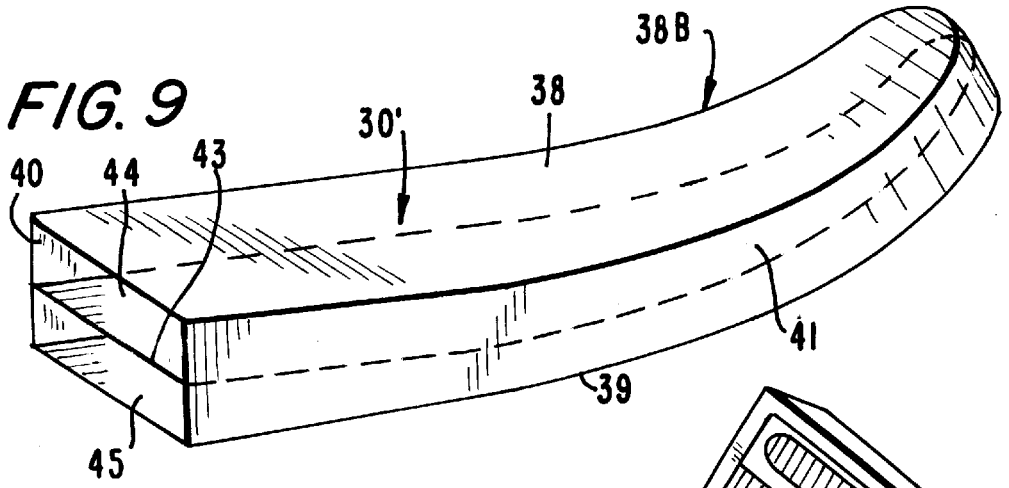
FIG. 9 shows the gripping means of a second embodiment illustrated partly in section and partly in perspective.

In an alternative construction, as illustrated in FIG. 9, cover 38B is show with the blade spring 42 omitted and instead, a dividing wall 43 placed in a plane essentially half-way between the top part 38 and the bottom part 39, so that an upper chamber 44 and a lower chamber 45 are formed. The top part 38, the bottom part 39 and the side parts 40,41 are tailored similarly to cover 38A, so that in two opposite positions the cover 38B can be given a shape corresponding to that shown in FIG. 8. By loading the upper chamber 44 by compressed air and emptying the lower chamber 45 of compressed air, the cover 38A may assume a position corresponding to that shown by the solid lines in FIG. 9. By emptying the upper chamber 44 of compressed air and filling the lower chamber 45 with compressed air, the means 30' will be made to curve, corresponding to that shown by the broken lines in FIG. 8.

FIG. 10 shows a patient turner 10 in the form of a bed couch having three separate sections 10*a*, 10*b*, 10*c* that can swing about relative to each other, i.e., a leg support section 10*a*, a body support section 10*b* for support of the major portion of the body of the patient 35, and a third section 10*c*, which forms a so-called "heart board" for the support of the head and shoulders of the patient 35. According to this embodiment the patient turner 10 may be used in a conventional sickbed, where bottom parts of the patient turner 10 and the associated gripping means 30,31 form the bed couch itself. In such a case a separate mattress, as indicated by the broken lines 52 in FIG. 11, may be placed on top of the patient turner 10 to form a part of the bed couch. In addition there is shown in FIG. 11 an elastically yielding wedge-shaped insert member 53, made for example from foam rubber, placed in the angular gap 54 between sections 10*b* and 10*c*.

Figure 11:
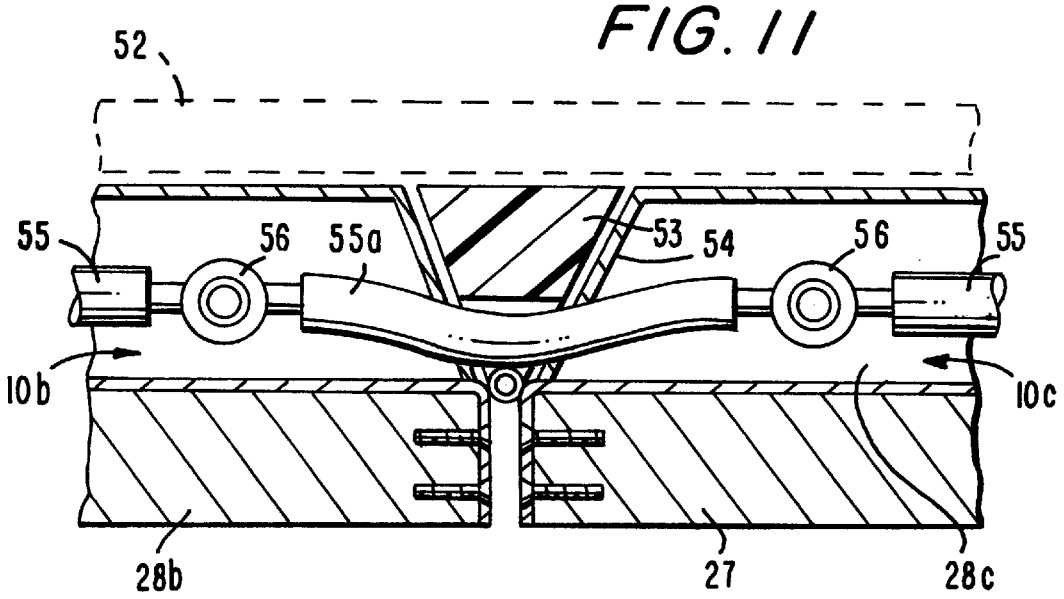
FIG. 11 shows in longitudinal section a segment of details of the apparatus according to the invention.

The support means are, as shown in FIG. 11, divided into two separate sections 28*b* and 28*c* connected at their respective bottom parts sections 10*b*, 10*c*, receiving a hose-shaped connection conduit 55 with associated branch nipple 56 for each gripping means. The conduit 55 may extend relatively tightly stretched between nipples 56 of the respective sections, while the conduit, as shown at 55 may assume a more curved course in the transition between each pair of support sections 28*b*,28*c*.

Figure 12:
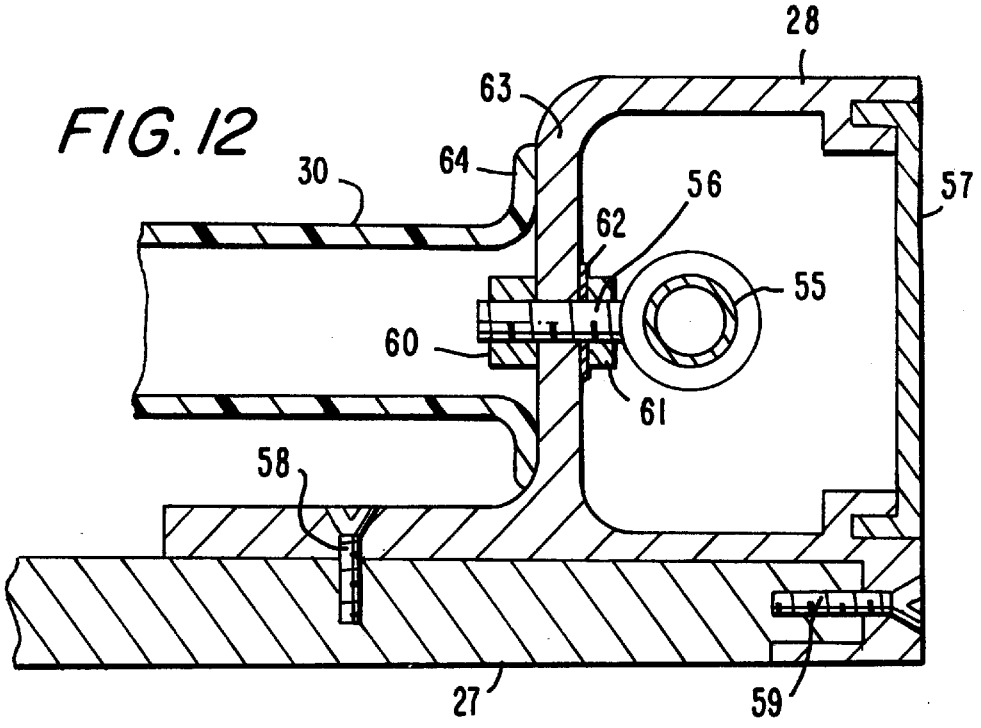
FIG. 12 shows a cross-section further details corresponding to those illustrated in FIG. 11.

FIG. 12 shows a section through the support means 28. The figure shows a removable back piece 57 whereby access to the conduit 55 and associated nipples 5 can be provided. Included in the figure are screws 58, 59 for securing the support means 28 to the bottom plate 27 and a screw-threaded nipple 56 with associated fastening nuts 60,61 together with packing ring 62 for fastening the nipple 56 via a boring in the adjacent wall 63 of the support means 28. Each gripping means 30 is fitted with a flange 64 which, for example, is fixed by vulcanisation to said wall 63 of the support means 28.

Figure 13:
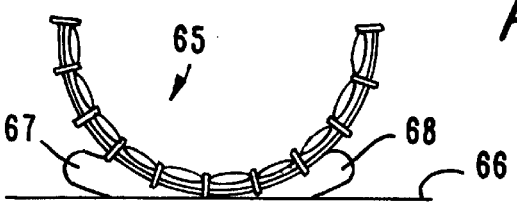
FIGS. 13–15 show a cradle-shaped apparatus according to an alternative embodiment of the invention in three different positions.
Figure 14:
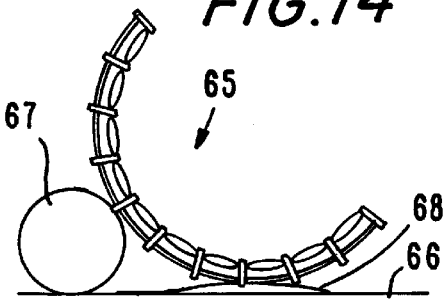
Figure 15:
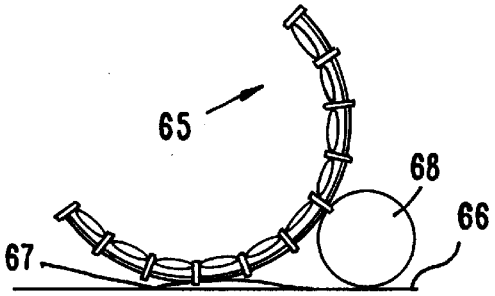

FIGS. 13–15 show, in end view, an U-shaped cradle arrangement 65, as an alternative embodiment of the cradle arrangement according to FIGS. 1–12. The cradle arrangement 65 is shown in a middle starting position in FIG. 13, in which the cradle arrangement rests against a base 66. The base 66 is fitted with cushion forming actuating means 67,68 which are pressurized using compressed air. In the maximum outer positions illustrated in FIGS. 14 and 15, one actuating means is pressurized while the remaining actuating means is relieved of pressure. By alternating the pressurizing and pressure relieving of the actuating means 67,68 the cradle arrangement 65 itself may readily be readjusted by moving it directly on the base 66. In other words, in this embodiment the cradle arrangement 65 may be moved on the base 66 with the aid of an extra actuating means 67,68.

Figure 16:
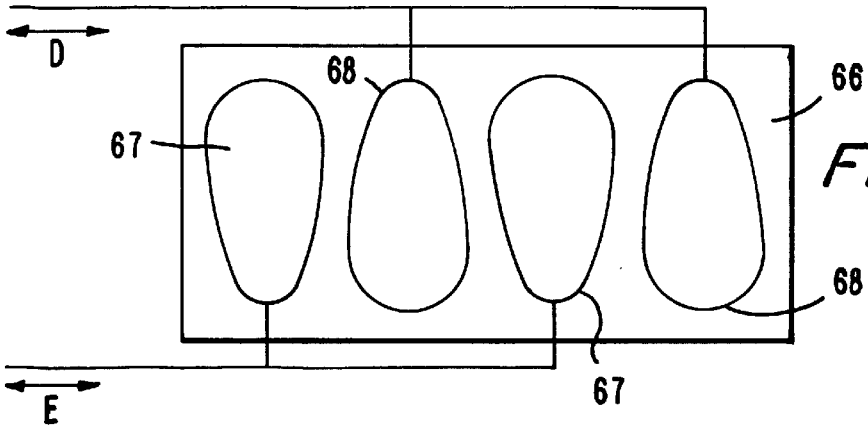
FIG. 16 shows in plan a base for the arrangement according to FIGS. 13–15.

A plan view of a base 66 having a first pair of actuating means 67 and a second pair of actuating means 68 is shown in FIG. 16. The means 67 and 68 may be controlled via their respective control valves by a control installation corresponding to that shown in FIG. 1, indicated by double arrows D and E.

The readjustment of the cradle arrangement 65 from an inactive, predominantly planar or slightly curved bed couch to a very curved bed couch is carried out in this instance by actuating mean which are controlled independently of the actuating means 67,68 as will be described below.

Figure 17:
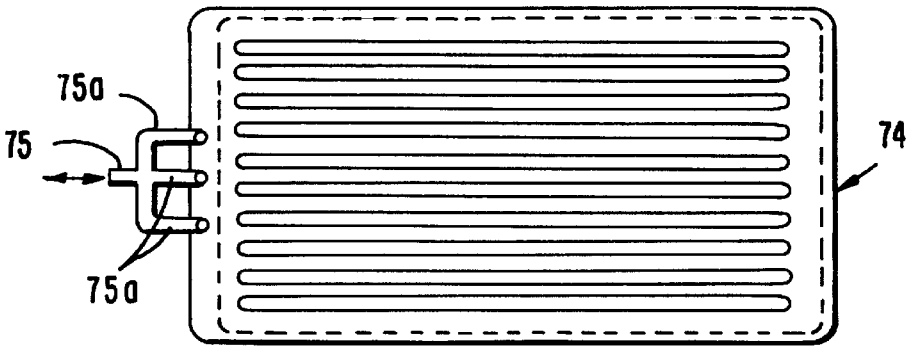
FIG. 17 shows in plan a couch-forming component which forms a part of the arrangement of FIGS. 13–15.
Figure 18:
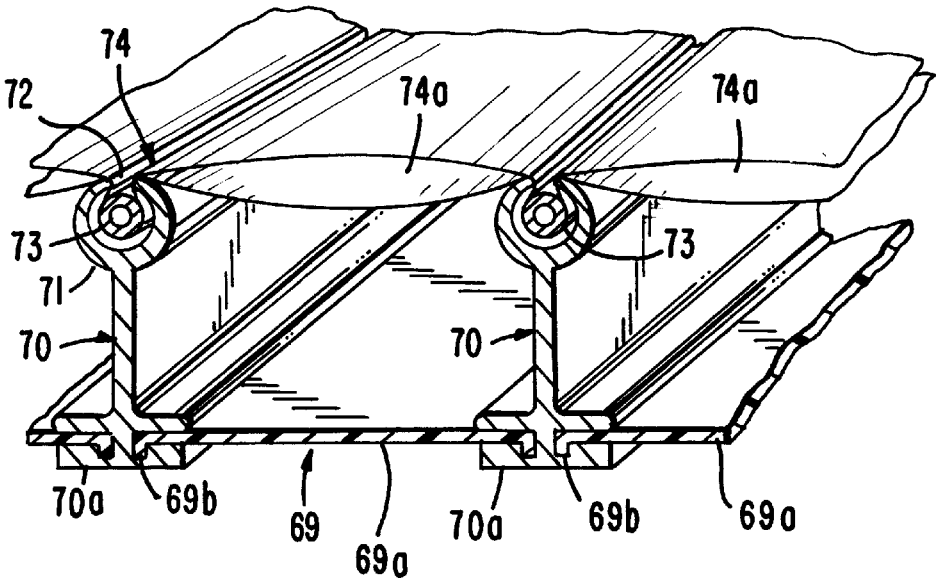
FIGS. 18 and 19 show a detail of the arrangement according to FIGS. 13–15, illustrated in segment and shown in two different actuating positions.
Figure 19:
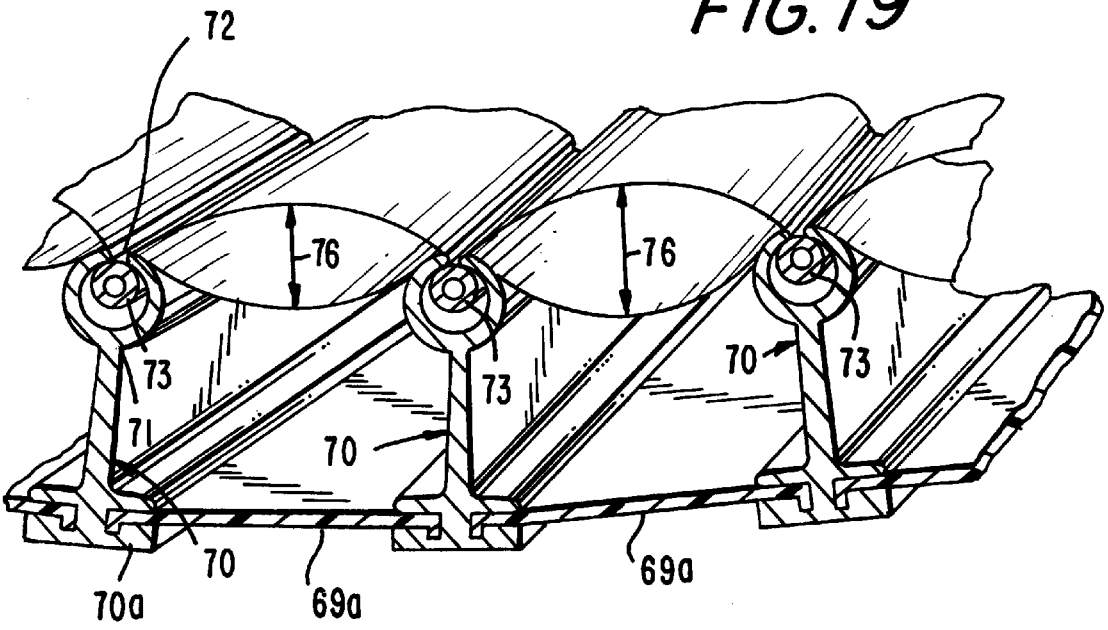

The cradle arrangement 65, shown generally in FIGS. 13–15 and in further detail in the segments of FIGS. 17–19, is fitted with a bottom part 69, which consists of several strip-shape bottom sections 69*a*, which are bound together in pairs and are relatively rigid. The bottom sections 69*a* are secured in pairs to intermediate, profile-shaped, rigid reinforcing means 70 to form a continuous jointed bottom part 69. The bottom sections 69*a* are fitted in this connection with opposing edging ribs 69*b*, which are anchored in respective L-shaped cavities in a lower base part 70*a* of the respective reinforcing means 70.

The top of the reinforcing means 7 is fitted with a head section 71 with an upward opening locking groove 7, as shown in FIGS. 18–19. A pipe-shaped locking member 73 and a turned about portion of a compressed air bag 74 are introduced endways into the locking groove 72. By means of the locking member 73 and the cooperating locking grooves 72, bag sections 74*a* of the compressed air bag 74 may be limited to a width dimension substantially equivalent to the width dimension as shown for the bottom sections 69*a*. A schematic plan view of the compressed air bag 74 is shown in FIG. 17, wherein the bag sections 74*a* are shown schematically in the form of parallel extending panels in the longitudinal direction of the bag 74. In the illustrated embodiment, a single compressed air bag 74 is shown, and this may constitute the whole of the bed couch, but in practice an equivalent compressed air bag may be employed in each of the sections 10*a*, 10*b*, 10*c* as shown in FIG. 1.

The compressed air bag 74 is inflated with pressure medium via a compressed air conduit 75 with associated branch conduits 75*a*, as shown in FIG. 17, and the bag sections 74*a* are then inflated from the position shown in FIG. 18 to the position shown in FIG. 19.

On as indicated by the double arrow 76 in FIG. 19, the bag sections will bulge out in the direction of the double arrow 76, while the head parts 72 of the reinforcing means 70 are forced against each other by tractive power to bring about a sideways contraction of the bag 74 relative to the bottom part 69. In the position shown in FIG. 17, the bag 74 assumes an inactive, relatively planar position, corresponding to that shown in FIG. 18, while in the inflated position in FIG. 19, it assumes a position corresponding to that shown in FIGS. 13–15.

What is claimed is:

1. Process for handling of a person in a rocking movement on a couch relative to a base employing a pressure medium-driven actuating means in the couch, the couch is converted by means of the pressure medium driven actuating means from a substantially planar or slightly bent starting position, with the person resting against the couch, to a C-shaped holding position bent about the longitudinal axis of the person, with the person enveloped in a holding grip over an arc angle of about 180°, wherein the person enveloped in the C-shaped holding position of the couch is moved relative to the base in a rocking movement from side to side without the use of a pivotal axis.

2. Arrangement for handing for a person in a rocking movement on a base employing a pressure medium-driven actuating means within a couch, the couch being convertible by means of pressure medium-driven actuating means from a substantially planar or slightly bent starting position, with the person resting against the couch, to a C-shaped holding position bent about the longitudinal axis of the person, with the person enveloped in a holding grip over an arc angle of approximately 180°, the couch in its C-shaped holding position is moveable by means of the pressure medium-driven actuating means in a rocking movement from side to side without the use of a pivotal axis.

3. Arrangement in accordance with claim 2, wherein a C-shaped bed couch which is formed to a C-shape by means of said actuating means is rollable directly on an associated base controlled by a second set of actuating means.

4. Arrangement in accordance with claim 2, wherein said actuating means converts the couch between a substantially planar or slight bent position to a bent, C-shaped cradle-forming holding position, and controls the couch in a rocking movement from side to side.

5. Arrangement in accordance with claim 4, wherein said actuating means are in the form of a first and second group of chamber-shaped gripping means, each group of gripping means being fastened, individual gripping means by individual gripping means, to opposing side edges of a base, each individual gripping means within each group extending side-by-side with mutual intermediate spaces formed between the respective fastened gripping means and projecting freely outwards relative to the base in a direction towards the respective opposite side edge of the base, and positioned within the laterally arranged intermediate spaces between the gripping means of the opposing group of gripping means, the two opposing groups of gripping means forming a common engagement zone with uniformly distributed engagement surfaces at respective opposite side edges of said base.

6. Arrangement in accordance with claim 5, wherein each of said first and second group of gripping means are adapted, by means of regulating means to be readjusted from an inactive condition with largely planar extending or slightly bent gripping means to an activated condition with regulatably bent gripping means, the gripping means in the activated condition being adapted to envelop the person jointly in an elastically yielding manner, to form said engagement zone, while by means of the regulating means the gripping means are adapted to move the person, who is enveloped in the engagement zone, in a rocking movement from side to side by equivalently increasing and deceasing the bending of the gripping means.

7. Arrangement in accordance with claim 5, wherein each of said gripping means comprises a flexible and locally deformable cover, which is made of a pliable, flexible, inelastic material and which is activatable by means of a pressure medium and wherein the cover is provided with at least one longitudinal chamber, the volume of which can be respectively filled with said pressure medium and drained of said pressure medium via an associated regulating means for adjusting the position of the gripping means.

8. Arrangement in accordance with claim 7, wherein the cover of the gripping means is provided, in addition to said at least one longitudinal chamber for adjusting the degree of bending of the gripping means, with a blade spring, which is adapted to laterally reinforce the gripping means, and is further adapted to ensure movement of the gripping means in a direction in a plane at right angles to the blade spring.

9. Arrangement in accordance with claim 8, wherein said blade spring has in an unloaded condition a substantially rectilinear outline and in a pressure medium loaded condition is pressure loaded to a bent outline against the inherent spring force of the blade spring.

10. Arrangement in accordance with claim 5, wherein a cover on each gripping means comprises an upper chamber and a lower chamber, the upper chamber and the lower chamber are individually connected to a source of pressure medium via an associated regulating means, the upper chamber, which is permanently substantially filled with pressure medium, forms an air cushion layer of each gripping means, and the lower chamber is adapted by means of the associated regulating means to adjust the degree of bending of the gripping means.

11. Arrangement in accordance with claim 6, wherein the regulating means are controlled by a microprocessor, and that the microprocessor is controlled by a pressure sensor, which is connected to the gripping means at a support surface against the person.

* * * * *